US010463177B2

(12) United States Patent
Rubio et al.

(10) Patent No.: US 10,463,177 B2
(45) Date of Patent: Nov. 5, 2019

(54) WALL MOUNTED ILLUMINATED BOX ASSEMBLY WITH LENS FOR DISPLAY OF ARTWORK

(71) Applicants: Rowena Rubio, New York, NY (US); Edward Ikeguchi, New York, NY (US); Griffin Michael Kearney, Syracuse, NY (US)

(72) Inventors: Rowena Rubio, New York, NY (US); Edward Ikeguchi, New York, NY (US); Griffin Michael Kearney, Syracuse, NY (US)

( * ) Notice: Subject to any disclaimer, the term of this patent is extended or adjusted under 35 U.S.C. 154(b) by 0 days.

(21) Appl. No.: 16/103,397

(22) Filed: Aug. 14, 2018

(65) Prior Publication Data

US 2019/0053643 A1 Feb. 21, 2019

Related U.S. Application Data

(60) Provisional application No. 62/546,759, filed on Aug. 17, 2017.

(51) Int. Cl.

| | |
|---|---|
| ***A47F 11/10*** | (2006.01) |
| ***A47G 1/06*** | (2006.01) |
| ***A47F 3/00*** | (2006.01) |
| *F21Y 115/10* | (2016.01) |
| *A47F 5/08* | (2006.01) |

(52) U.S. Cl.

CPC ..... *A47F 11/10* (2013.01); *A47F 3/001* (2013.01); *A47G 1/0622* (2013.01); *A47F 5/08* (2013.01); *F21Y 2115/10* (2016.08)

(58) Field of Classification Search

CPC . A47F 11/10; A47F 3/001; A47F 5/08; A47G 1/0622; F21Y 2115/10; G03B 21/00

See application file for complete search history.

(56) References Cited

U.S. PATENT DOCUMENTS

| | | | | |
|---|---|---|---|---|
| 4,162,814 A * | 7/1979 | Garbero | F21S 9/02 312/114 |
| 7,585,085 B1 * | 9/2009 | Holman | G09F 13/02 362/154 |
| 2003/0015945 A1 * | 1/2003 | Vandenbussche | A47F 3/001 312/114 |
| 2012/0020112 A1 * | 1/2012 | Fisher | A47B 13/12 362/608 |
| 2017/0285342 A1 * | 10/2017 | Lee | G02B 6/0008 |

FOREIGN PATENT DOCUMENTS

| | | | |
|---|---|---|---|
| CN | 2040269 U * | 6/1989 | |
| DE | 2730679 A1 * | 1/1979 | A47F 11/04 |

OTHER PUBLICATIONS

Machine English Translation of DE2730679A1 (Year: 1979).*
Machine English Translation of CN204269U (Year: 1989).*

* cited by examiner

*Primary Examiner* — Anh T Mai
*Assistant Examiner* — Glenn D Zimmerman
(74) *Attorney, Agent, or Firm* — John M. Griem, Jr.; Danielle C. Sullivan; Carter Ledyard & Milburn, LLP

(57) ABSTRACT

An apparatus for the display of artwork including a central box, the central box housing the artwork, a lighting tray located above the central box, the lighting tray housing lights that shine into the central box onto the artwork, a lighting power source, and a peephole in the central box, the peephole having a convex lens.

12 Claims, 4 Drawing Sheets

WALL MOUNTED ILLUMINATED BOX ASSEMBLY WITH LENS FOR DISPLAY OF ARTWORK

This application claims priority to U.S. Provisional Patent Application No. 62/546,759 filed Aug. 17, 2017 entitled "WALL MOUNTED ILLUMINATED BOX ASSEMBLY WITH LENS FOR DISPLAY OF ARTWORK" and is hereby incorporated by reference in its entirety.

FIELD OF THE INVENTION

The present invention relates to artwork display boxes.

BACKGROUND OF THE INVENTION

Boxes for the display of artwork are known. Such boxes protect the artwork arranged inside and focus the viewer's attention on the art. They also permit more convenient transport and storage of the arranged art. Some of these boxes have peepholes on the front, which require the viewer to directly engage with the display box by looking through the peephole in order to see the artwork arranged inside the box.

There exists a need, however, for an artwork display box that has an internal lighting system and a convex lens in the peephole viewer that allows the viewer to see clearly an art display that has many carefully arranged and very small elements. There also exists a need for various lighting designs for use with such a display box that can save energy, avoid the need to replace batteries or temporary lighting sources, and avoid unsightly wires that detract from the external presentation of the display box. It is therefore an object of the invention to provide such an artwork display box that meets these needs.

SUMMARY OF THE INVENTION

An artwork display box assembly has been invented that can be mounted on the wall and contains an internal lighting system and a convex lens permitting a viewer to look into the box to observe artwork arranged inside the box. The box of the present invention must be sufficiently rigid to hold the artwork and contain a peephole having a convex lens therein, and it is preferably mountable to a wall in some fashion. The box of the present invention must also have a lighting system for illuminating the art inside the box at the time the viewer is looking at it. Embodiments of the invention also include a box made using 3D printable plastic and including a bracket box that can be affixed to the wall and used as a base onto which the artwork display box is mounted. Embodiments of the invention also include lighting systems that include battery-powered tea lights or LEDs. Additional lighting embodiments include a proximity sensor for turning on the lights when a viewer places his or her eye to the peephole, and a solar cell for powering LED lights inside the box using light from the sun or ambient light inside an art gallery or other indoor space. The artwork display box can be used for the purpose of displaying imagery, for example, amongst other artwork content.

The present invention provides an apparatus for the display of artwork including a central box, the central box housing the artwork, a lighting tray located above the central box, the lighting tray housing lights that shine into the central box onto the artwork, a lighting power source, and a peephole in the central box, the peephole having a convex lens.

DETAILED DESCRIPTION OF THE INVENTION

Figure 1:
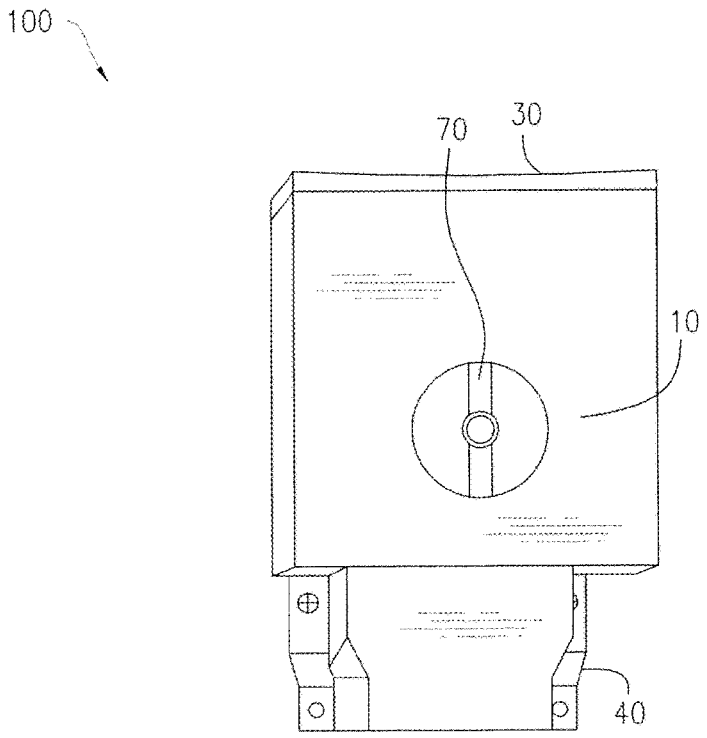
FIG. 1 illustrates an exterior front view of an embodiment of the invention.
Figure 2:
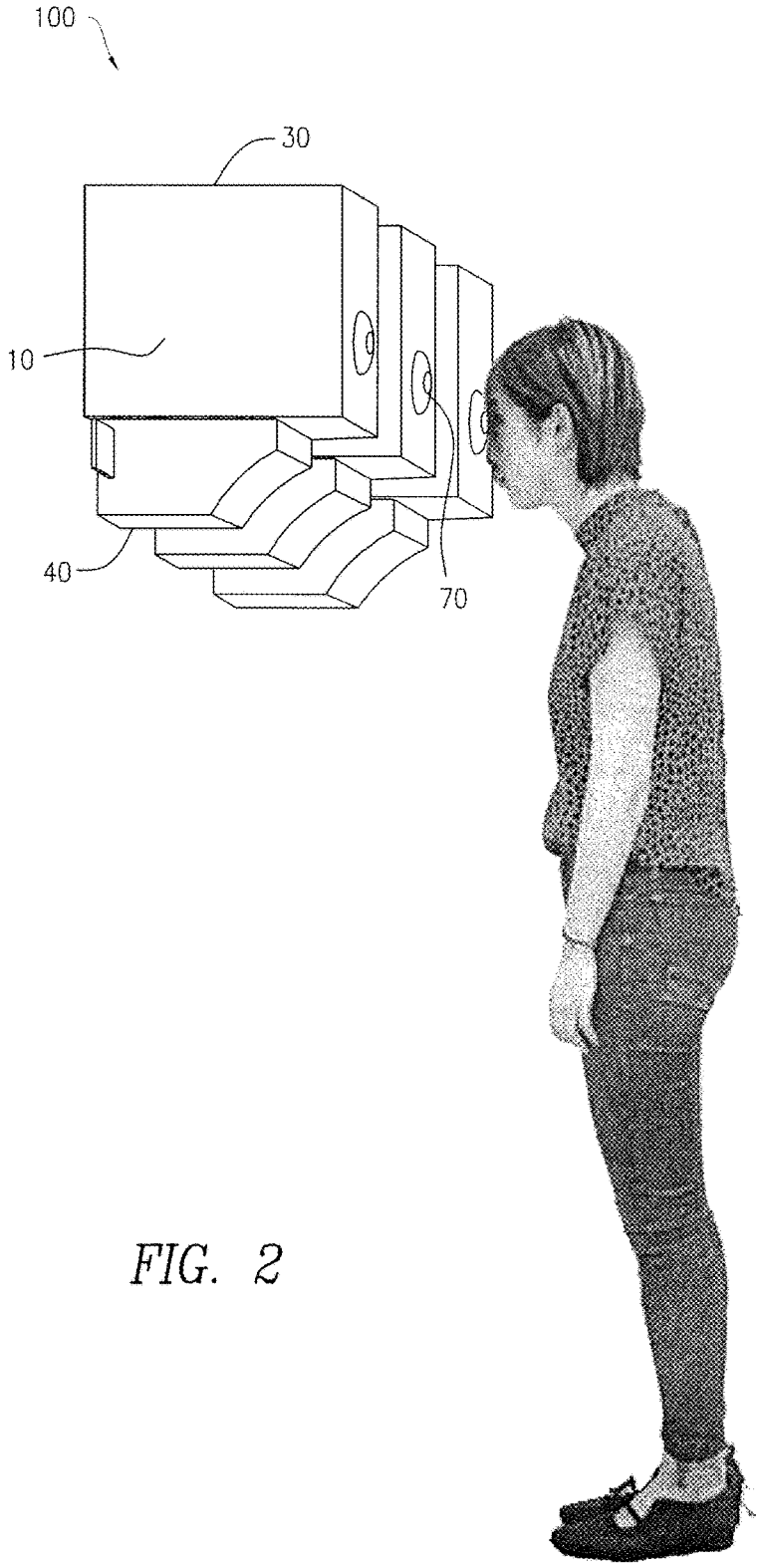
FIG. 2 illustrates a side view of an embodiment of the invention showing a woman looking in an art box.

FIGS. 1 and 2, show two different perspectives of an embodiment of the invention of the enclosed artwork box 100. FIG. 1 shows the inventive box from the front and FIG. 2 shows the inventive box from the side with a person looking in the peephole. The box can be made using 3D printable plastics, such as Polyacrylic Acid, however any material may be used to construct the box so long as the material is sufficiently rigid to hold a box shape.

Figure 3:
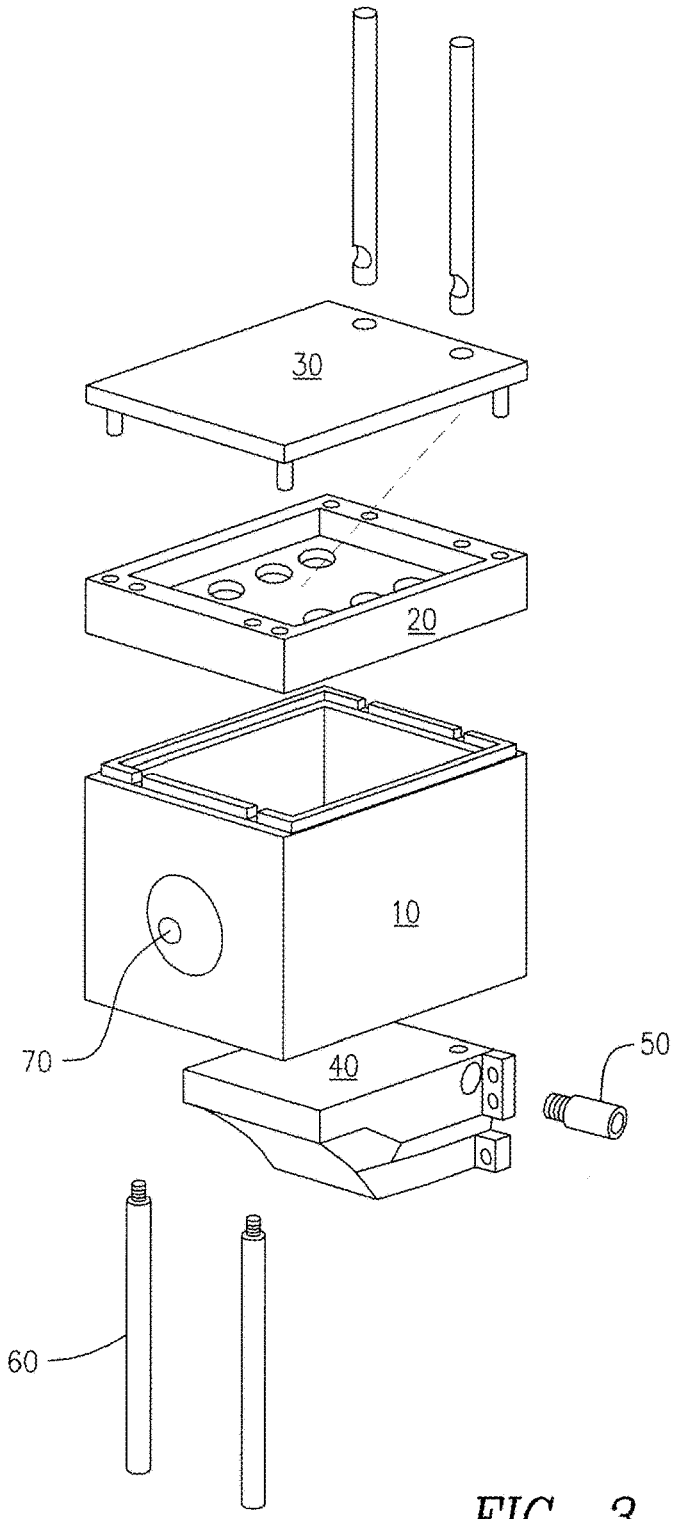
FIG. 3 illustrates the pieces of an embodiment of the invention.

The artwork box 100 includes a generally cubic central box 10, tray 20 (not visible in FIGS. 1 and 2) on top of central box 10 that holds lights that shine down into central box 10, and a top 30 that fits on top of central box 10 and lighting tray 20. Box 100 may be mounted on the wall using bracket box 40 that is affixed to a wall. Central box 10, lighting tray 20 and top 30 can then be connected to bracket box 40 by pegs 50 and bolts 60 shown in FIG. 3. Box 100 can also be connected and assembled using conventional fasteners such as nails, screws and glue. Alternatively, top 30 can be hinged to lighting tray 20, and lighting tray 20 can be hinged to central box 10. Central box 10, tray 20 and top 30 can be attached to a wall by means other than bracket box 40, or could be suspended from the ceiling or placed on a table or pedestal without bracket box 40.

Each box 100 has a peephole 70 in the front of central box 10. Peephole 70 is fitted with a convex lens 80. One example of a suitable convex lens may have the dimensions 1.1×4.6×2.8 inches, weighing approximately 1.3 ounces, for example. Artwork is placed in central box 10 a few inches from the eye. Lens 80 is thinner at the center than at the edges and allows the viewer to see all or substantially all of the artwork arranged inside box 100. Convex lens 80 does this by allowing parallel rays of light to pass through, refract and diverge, making the content appear smaller and distant from the eye and appearing to come from one point. This allows a complex artwork scene to fit into a small space while still allowing the eye to view the entirety of the content. This also allows the artist more room to manipulate the lights and scenery to create a unique visual effect which would not be possible in such a small space without the present invention. Without lens 80, a person would not be able to discern what is in the box because of the proximity of the artwork and the peephole in which the person views the artwork.

Lighting tray 20 contains lights that shine into central box 10. The lighting tray may also include adjustable sliding brackets that provide the ability to adjust the positioning of each individual light. The sliding brackets may hold each individual light or a group of lights within lighting tray 20. Since the art displayed in the box varies, the adjustable sliding brackets allow flexibility with the positioning of each light. One example includes placing brackets of LED lights at the front of lighting tray 20 and the sides of lighting tray 20. This positioning will illuminate the art in central box 10 from different angles and cast different shadows. The lights may be any light sources suitable for illuminating the art without creating too much heat inside box 100. In one embodiment, small commercially available electric tea lights having internal batteries are used. These lights may be 1.2×1.2×1.2 inches weighing approximately 0.3 ounces each, for example. If these lights are used, they must be replaced periodically with new lights having fresh batteries, or the batteries replaced. Alternatively, light emitting diode (LED) lights may be used, such as white LEDs, however, the lights need not be LED. The lights can be any color or colors. If LED lights are used, a power source must be added. This power source can be an energy storage device including, but not limited to, a battery and/or super capacitor, which must be replaced from time to time, or used in conjunction with an energy generation device such as a solar cell that generates power from available light where box 100 is located. A USB rechargeable battery may be used and can be built into bracket box 40. USB batteries are easy to charge in situ, or swap as needed for external charging. For example, a single USB rechargeable battery can provide about 300 viewing hours. The power source can also be a cord connected to a conventional wall plug and a transformer suitable to change the voltage to a level acceptable to the lighting sources. The power source may also be a cord connected to a USB plug that can draw power from a computer or USB-compatible device.

Figure 4:
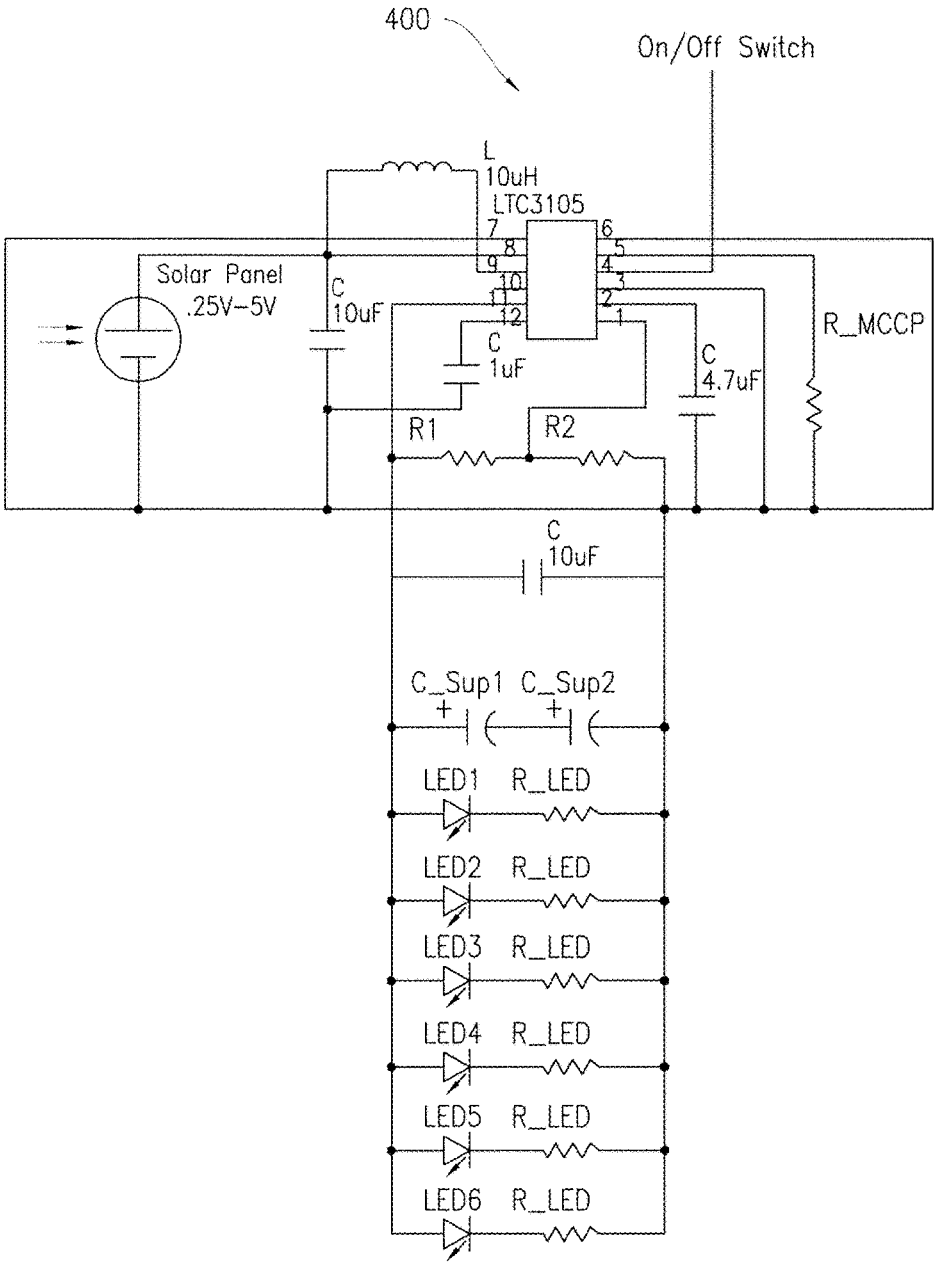
FIG. 4 shows a circuit schematic for a circuit that can be used to power LED lights inside an embodiment of the invention.

A circuit diagram 400 for a suitable example electric circuit to supply power to LED lights in the milliwats range from a solar panel is shown in FIG. 4. The parts to be used with this circuit may include the following: Eaton Super Capacitor (504-XV3560-2R7407-R), to store the energy to drive the LEDs; PIXNOR Assorted Resistors, to support current regulating the LEDs and an MPPC IC which is used to condition the power output from the solar cell to the super capacitors when charging; Foxnovo Assorted Capacitors, to support the use of the IC; assorted Inductors, to prevent current runaway at the IC during transient loads; ALLPOWERS 2.5 W 5V/500 mA Mini Solar Panel; Linear Technology MCCP IC (LTC3105EMS#TRPBF); a board for IC mounting; a Schmart Prototyping Board, to support surface mounted components; and white LEDs (specs: 3-3.2V@15-18 mA 20 mA max).

The above circuit 400 includes an on/off switch, which can be connected to any type of switch. Possible switches include a proximity sensor, which is located near or on the eyepiece of the convex lens 80 and which causes the lights to turn on inside box 100 when a viewer puts his or her eye up to peephole 70. Using a proximity sensor as the on/off switch on the system, allows the circuit to store energy into capacitors until someone puts their eye to the device. The use of a proximity sensor turning the lights on and off as needed, coupled with a USB rechargeable battery can provide months, if not years of light source energy on a single charge. One example of a proximity sensor is the Semtech SX9310ICSTRT. Other sensors can be used, such as optical, acoustical, thermal, IR camera, or RFID. Alternatively, the on/off switch may be attached to a manual switch or a switch that operates on a timer. Circuit 400 can be placed on a board which is then located in bracket box 40 or on the underside of the central box 10, for example. Thin wires connecting the circuit board can then be run up the back of the central box 10 to connect to lights in lighting tray 20. Other hidden wires can connect the circuit board to a solar panel located on the top of the lid 30 of box 100. The solar panel may be flush against the top 30 of box 100, or mounted at an angle to better receive light from sources not directly over the top of the box.

Although the present invention has been described in conjunction with specific embodiments, those of ordinary skill in the art will appreciate the modifications and variations that can be made without departing from the scope and spirit of the present invention.

The invention claimed is:

1. An apparatus for the display of artwork comprising:
- a central box, the central box housing the artwork, the central box having 4 side walls, a top and a bottom;
- a lighting tray located on the top of the central box, the lighting tray housing lights that shine into the central box onto the artwork;
- a lighting power source; and
- a peephole in the central box, the peephole having a convex lens, wherein a viewer uses the peephole to view the artwork, the artwork appearing smaller and more distant to the viewer and appearing to come from one point, allowing the viewer to view the entirety of the artwork.

2. The apparatus as recited in claim 1 further comprising a bracket box, the bracket box affixing the apparatus to a wall.

3. The apparatus as recited in claim 1 wherein the lights are LED.

4. The apparatus as recited in claim 1 wherein the lighting power source is batteries.

5. The apparatus as recited in claim 1 wherein the lighting power source is a solar cell, the solar cell being located on top of a lid of the central box and the lighting tray.

6. The apparatus as recited in claim 1 wherein the artwork is placed a few inches from the eye of the viewer.

7. The apparatus as recited in claim 1 wherein the central box is cubic.

8. An apparatus for the display of artwork comprising:
- a central box, the central box housing the artwork;
- a lighting tray located above the central box, the lighting tray housing lights that shine into the central box onto the artwork;
- a lighting power source;
- a peephole in the central box, the peephole having a convex lens; and
- a proximity sensor, the proximity sensor turning the lights on when a viewer puts their eyes on the peephole.

9. The apparatus as recited in claim 8 wherein the proximity sensor is located near or on an eyepiece of the convex lens.

10. The apparatus as recited in claim 8 further comprising adjustable sliding brackets, the adjustable sliding brackets being located in the lighting tray.

11. The apparatus as recited in claim 8 wherein the lighting power source is a USB rechargeable battery, the battery being located in a bracket box.

12. The apparatus as recited in claim 10 wherein the adjustable sliding brackets hold the lights allowing the lights to be specifically positioned.

* * * * *